United States Patent [19]

Nicholson

[11] Patent Number: 4,850,304

[45] Date of Patent: Jul. 25, 1989

[54] AUTOMATION SYSTEM FOR A MIXING AND DISPENSING APPARATUS

[76] Inventor: James E. Nicholson, 322 Chisholm Trail, Sherman, Tex. 75090

[21] Appl. No.: 139,102

[22] Filed: Dec. 23, 1987

Related U.S. Application Data

[63] Continuation of Ser. No. 881,350, Jul. 2, 1986, abandoned.

[51] Int. Cl.[4] ..... B05B 15/00

[52] U.S. Cl. ..... 118/694; 118/697; 118/310; 427/188; 222/132; 222/415; 222/129

[58] Field of Search ..... 222/132, 415, 129; 118/694, 697, 310; 427/188

[56] References Cited

U.S. PATENT DOCUMENTS

| | | | |
|---|---|---|---|
| Re. 20,660 | 2/1938 | Schacht | 118/308 |
| 1,584,557 | 5/1926 | Koch | 118/310 X |
| 1,998,079 | 4/1935 | Freegard | 118/310 |
| 2,460,605 | 2/1949 | Soissa | 118/310 X |
| 2,864,537 | 12/1958 | Throop et al. | 222/57 |
| 2,977,924 | 4/1961 | Bender | 118/310 X |
| 2,982,445 | 5/1961 | Koble | 222/132 X |
| 3,049,436 | 8/1962 | Stewart et al. | 118/308 |
| 3,245,584 | 4/1966 | Linville | 222/132 |
| 3,332,578 | 7/1967 | Linville | 222/63 |
| 4,580,698 | 4/1986 | Ladt | 222/63 |
| 4,581,704 | 4/1986 | Mitsukawa | 222/55 X |

*Primary Examiner*—Shrive Beck

*Attorney, Agent, or Firm*—Alfred E. Hall

[57] ABSTRACT

In an automation system for a mixing and dispensing apparatus, different colors of granite granules are placed into different silos. Dampers and proportion gates on the bottom of the silos permit specific proportions of different granite colors to fall and mix on a conveyor. The granite color combination is transported through a bucket elevator to a lazy susan and from the lazy susan into a selected bin. A second combination of granite colors is then mixed by adjusting selected proportion gates and opening and closing selected dampers. The second color combination is transferred through the lazy susan to a second selected bin. Any number of color combinations can be made and transferred to selected bins. The granite color combinations from the several bins are then applied to an asphalt-coated fiberglass mat through a dispensing apparatus on the bottom of the selected bins. The entire process is automated and controlled through logic circuitry.

2 Claims, 12 Drawing Sheets

10
12
12
12
12
12
12
12
12
12
12
50
56
48
44
40
14
36
58
54
60
32
20
64
76
74
62
22
66
28
24
68
63
70
70
78
160
86
84
82
100
90
96C
94
96B
96A

FIG. 2
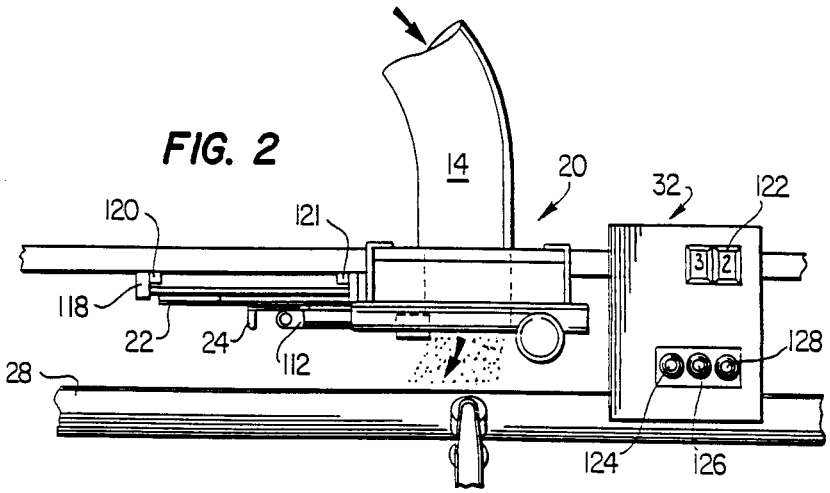
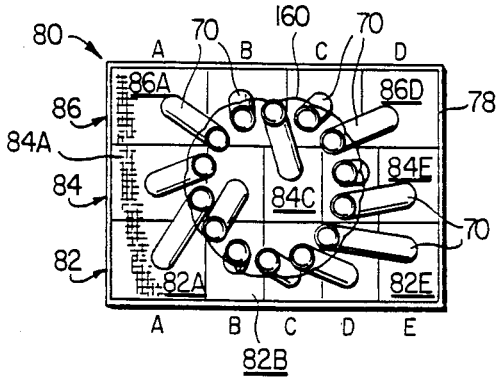
FIG. 4
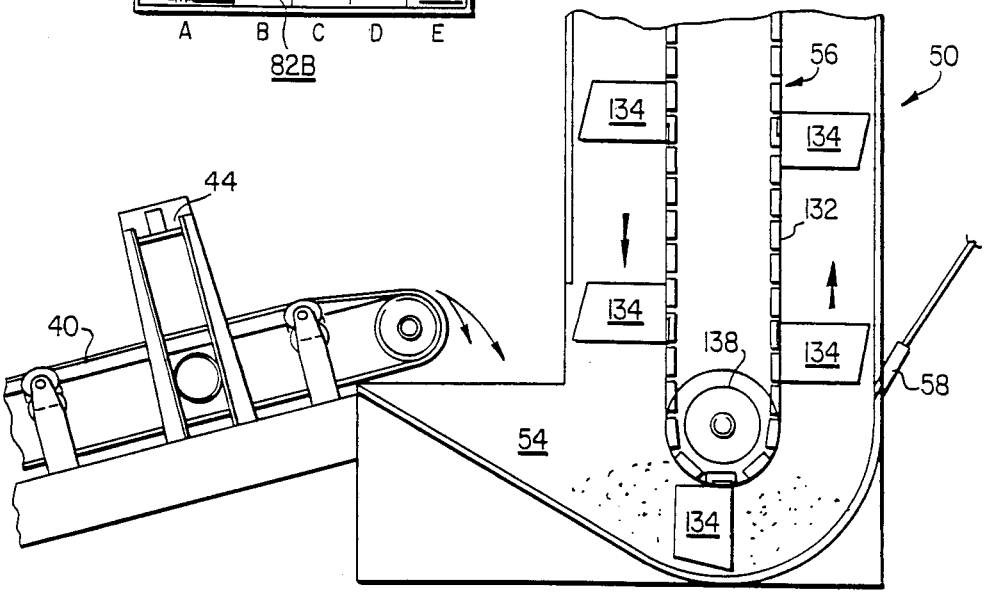
FIG. 3

300
306
312
316
318
302
310
320
328
308
326
224
230
330
226
330A
334
340
344
346
348
354
356
336
330B
360
364
372
374
376
326
336

AUTOMATION SYSTEM FOR A MIXING AND DISPENSING APPARATUS

This is a continuation of application Ser. No. 06/881,350 filed July 2, 1986 now abandoned.

BACKGROUND OF THE INVENTION

Many industrial processes require mixing of a first set of components to form a second set of components and then mixing or applying the second set of components in a particular manner to produce the finished product. For instance, in the manufacture of different shades of roofing shingles, different colors of granite granules are each placed in a separate silo. Several different colors are mixed to create three or four color combinations. Each separate color combination is transported to a separate dispensing bin, and the color combinations making up one shingle shade are then applied to an asphalt-coated fiberglass mat in a particular manner and sequence to provide shingles having the desired shade.

The silos holding the pure colors of granite granules have a proportion gate and a slide gate damper to control the output of the silo. Each color combination has a particular formula, and the proportion gates of the silos containing the required colors of granite granules must be set to provide the proper proportion of each individual color. When the dampers are opened, the granite granules from the chosen silos fall onto a conveyor and are mixed thereon. The color combination of granite granules is transported to a dispensing bin and held pending distribution onto the asphalt-coated mat. A second color combination is then mixed and transported to a second bin and, in most cases, third, fourth and fifth combinations are transported to third, fourth and fifth bins. Thus, each time a different color combination is to be mixed, the individual proportion gates must be adjusted and the slide gate dampers opened or closed to provide the proper formulation of each individual granite color to the mixture. Previously, workers at the plant adjusted the proportion gates and the slide gate dampers so that human error and negligence as well as the absence of simultaneous opening and closing of the slide gate dampers resulted in a slightly different color combination each time a specific combination was made.

The prior system also suffered from human error when providing the color combination to the appropriate bin because workers had to manually adjust a lazy susan in order to put the appropriate color combination into a specific bin. An inattentive worker often mistakenly placed the lazy susan outlet over the wrong input port or would turn the lazy susan while the color combination was flowing, thus causing granite granules to fall into several of the bins. Furthermore, the dispensing bins often ran out of one color combination before the run was finished so that either the shingles had a different shade for the remainder of that particular lot or the entire operation had to be shut down to permit mixing of a small amount of the needed granite granule combination to complete the run. Of course, because of human error this also resulted in a slightly different shade of shingle because the new color combination would have a slightly different color from the original color combination.

SUMMARY OF THE INVENTION

According to the present invention, the mixing and dispensing of the appropriate granite granule colors and color combinations are automated and controlled to reduce the cost and inefficiencies inherent in the previous system of making shingles. The invention is also useful in other industrial systems. According to the invention, the various colors of granite granules are automatically mixed in the proper proportion and supplied to the proper dispensing bin. Each of the dispensing bins required for a particular run of shingles is automatically provided with the appropriate granite color combination before starting the run. Should any of the bins run low during a particular run, the bin is automatically filled with the proper color combination so that each individual lot has a consistent color. Furthermore, because of the automation and controls of the present invention, each lot of a particular shingle shade has the same color as any other lot of that shade.

The present invention provides that while one shade of shingle is being made, the color combinations for a second shade may be loaded into a second set of dispensing bins. Therefore, a second shingle shade may be run shortly after the first is completed.

The present invention provides numerous equipment operational checks. For instance, should the color combination in one of the bins run low, the system mixes the required granite color combination and provides it to the bin before the bin is empty. Should the bin run extremely low on a specific color combination, an alarm sounds to alert the operator to take corrective action so that no shingles are wasted because of improper color. Should any of the silos fail to provide the required color, the mixing process is stopped and an alarm indicates the source of the problem.

BRIEF DESCRIPTION OF THE DRAWINGS

A more complete understanding of the invention may be had by reference to the following Detailed Description when taken in conjunction with the accompanying Drawings wherein:

FIG. 2 is a side view of the proportion gate, slide gate damper and silo control panels of the automation system and apparatus of FIG. 1;

FIG. 3 is a side view of the conveyor and scale leading to the bucket elevator of FIG. 1;

FIG. 4 is a top view of the lay-out of the bins and input ports of FIG. 1;

DETAILED DESCRIPTION

Figure 1:
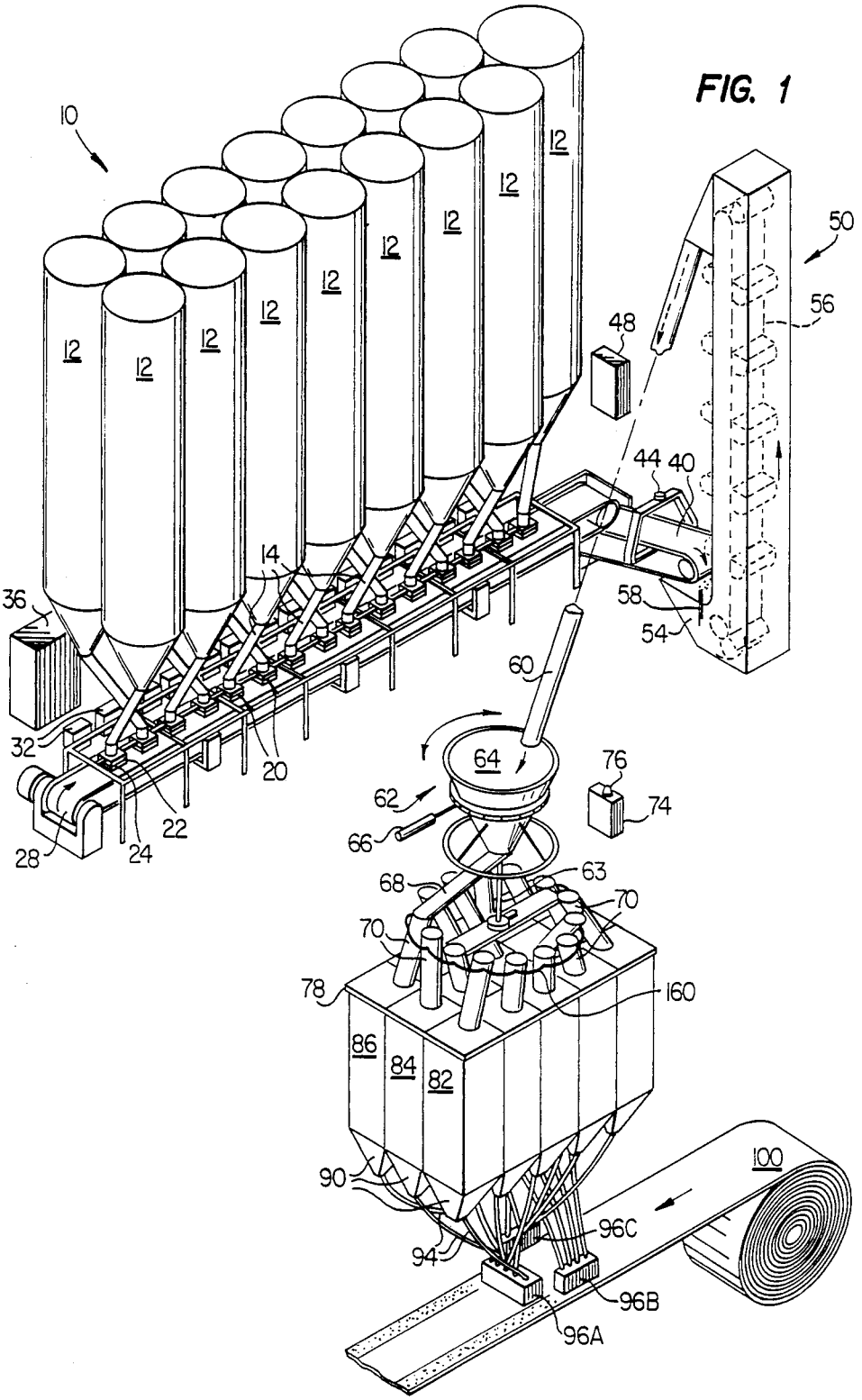
FIG. 1 is a perspective view of an automation system for a mixing and dispensing apparatus in accordance with the present invention.

Referring now to the Drawings, and particularly to FIG. 1 thereof, there is shown a mixing and dispensing apparatus 10 incorporating the present invention. The apparatus 10 includes a plurality of silos 12 with an outlet passage 14 on the lower portion of each silo 12.

Each silo 12 contains granite granules having a distinct color. A valve assembly 20 comprising a slide gate damper 22 and a proportion gate 24 is mounted on the bottom of each outlet passage 14. When the slide gate dampers 22 for a particular color combination are opened, the granite granules fall onto a conveyor 28 beneath the valve assemblies 20 in a measured proportion in relation to the proportion gate 24 setting and are transported in the direction of the arrow. A silo control box 32 is in front of each valve assembly 20 and a main control system box 36 is at one end of the conveyor 28.

Granite granules falling on the conveyor 28 are transported to a second conveyor 40. A scale 44 on the conveyor 40 weighs the granite granules being transported. A remote panel 48 for the silos and the scale is shown mounted near the second conveyor 40.

The conveyor 40 drops the granite granules into a bucket elevator 50 having a trough 54 for receiving the granules and a bucket belt assembly 56 for lifting the granules out of the trough 54. Air jets 58 are mounted on the trough 54 for cleaning out the trough 54.

From the top of bucket elevator 50 the granules pass down a chute 60 into a lazy susan 62 which is rotatable about a central axis as indicated by the arrows. In the embodiment shown in FIG. 1, the lazy susan 62 rotates about and is driven by a central axle 63. The lazy susan 62 has a hopper 64 for receiving the granules, a positioning rod assembly 66 for holding the lazy susan 62 in place and a sleeve 68 for dispensing the granules into input ports 70. A lazy susan control panel 74 having an alarm light 76 which contains an alarm horn is proximate the lazy susan 62.

The input ports 70 are mounted on a grate 78 over a bin assembly 80 having rows of granule dispensing bins 82, 84 and 86. Each of the input ports 70 leads into a specific granule dispensing bin. The identification of the individual bins is discussed in more detail with regard to FIG. 4 below.

On the bottom of each of the granule dispensing bins a hopper 90 leads to a hose 94 and into a granule dispenser 96A, 96B or 96C for dispensing the granules. An asphalt-coated mat 100 moves beneath the granule dispensers 96 in direction of the arrow. The granite granules are dropped onto the asphalt-coated mat 100 as is known in the art.

Referring now to FIG. 2, there is shown a side view of one valve assembly 20 and its associated silo control box 32. The valve assembly 20 comprises the proportion gate 24 which is driven by a linear actuator 112 on the bottom of the valve assembly 20. Above the proportion gate 24 is the slide gate damper 22 which is driven by an air cylinder 118 that has an open limit switch 120 and a closed limit switch 121 mounted thereon. The linear actuator 112 is an electromechanical actuator with built-in limit switches such as a the "Mini-Pac" manufactured by Duff-Norton. In operation the linear actuator 112 has a potentiometer 616 that indicates the position of the proportion gate 24. The programmable controller 340 compares the position of the proportion gate 24 with its proper position for the color combination formula being mixed and signals the linear actuator 112 to adjust the position of the proportion gate 24 as required.

The silo control panel 32 has a proportion indicator 122, a silo selector switch 124, a slide gate selector switch 126 and a position selector switch 128. The proportion indicator 122 indicates the position of the proportion gate 24. The silo selector switch 124 has three positions, one for selecting automatic operation of the valve assembly 20, one for selecting manual operation of the proportion gate 24 and the slide gate damper 22, and a third for deactivating the operation of the silo control panel 32. The slide gate selector switch 126 has an "open" and a "close" position for manually opening and closing the slide gate damper 22. The position selector switch 128 also has "open," "close" and "off" positions for manually moving the proportion gate 24 to a desired position setting.

FIG. 3 is a side view of the second conveyor 40 and the scale 44 leading into the trough 54 of the bucket elevator 50. Granite coming from the conveyor 28 falls onto the conveyor 40, is weighed by the scale 44 and falls into the trough 54. The scale 44 may be any of those known in the art such as the WS Series Weigh Scale system sold by Texas Nuclear.

The bucket elevator 50 has a bucket belt assembly 56 comprising a belt 132 to which are attached several buckets 134. The belt 132 rotates around the roller 138 in the direction indicated by the arrows and granite granules in the trough 54 are scooped out by the buckets 134 and lifted up the bucket elevator 50.

The air jets 58 are used when changing color combinations. For instance, when one granule dispensing bin has been filled, a different granite color combination must be transported to a second granule dispensing bin. However, a small amount of granules from the prior color combination remain in the trough 54. Therefore, the circuitry activates the air jets 58 to blow any remaining granules out of the trough 54 before the second color combination arrives. This is extremely important when the second color combination is to be a white or very light-colored mixture and the previous combination was a dark color. The result is that using the air jets 58 reduces the amount of shingles that are wasted due to improper coloration.

FIG. 4 shows a top view of the input ports 70 on the grate 78. The bin assembly 80 has 14 bins that are numbered as shown in FIG. 4, that is bins 82A, 84A and 86A are all along one column and bins 82B, 84B and 86B are also generally aligned. Because the row of bins 86 has only four bins and the rows of bins 82 and 84 have five bins, the bins 86 are not perfectly aligned with their respective counterparts of the bins 82 and 84.

Granite granules fall from the sleeve 68 of the lazy susan 62 into one of the input ports 70 in accordance with the positioning of the sleeve 68. The openings of the input ports 70 are all aligned in a circle so that the sleeve 68 may be placed in position over any one input port 70 to fill any specific granule dispensing bin.

Figure 9A:
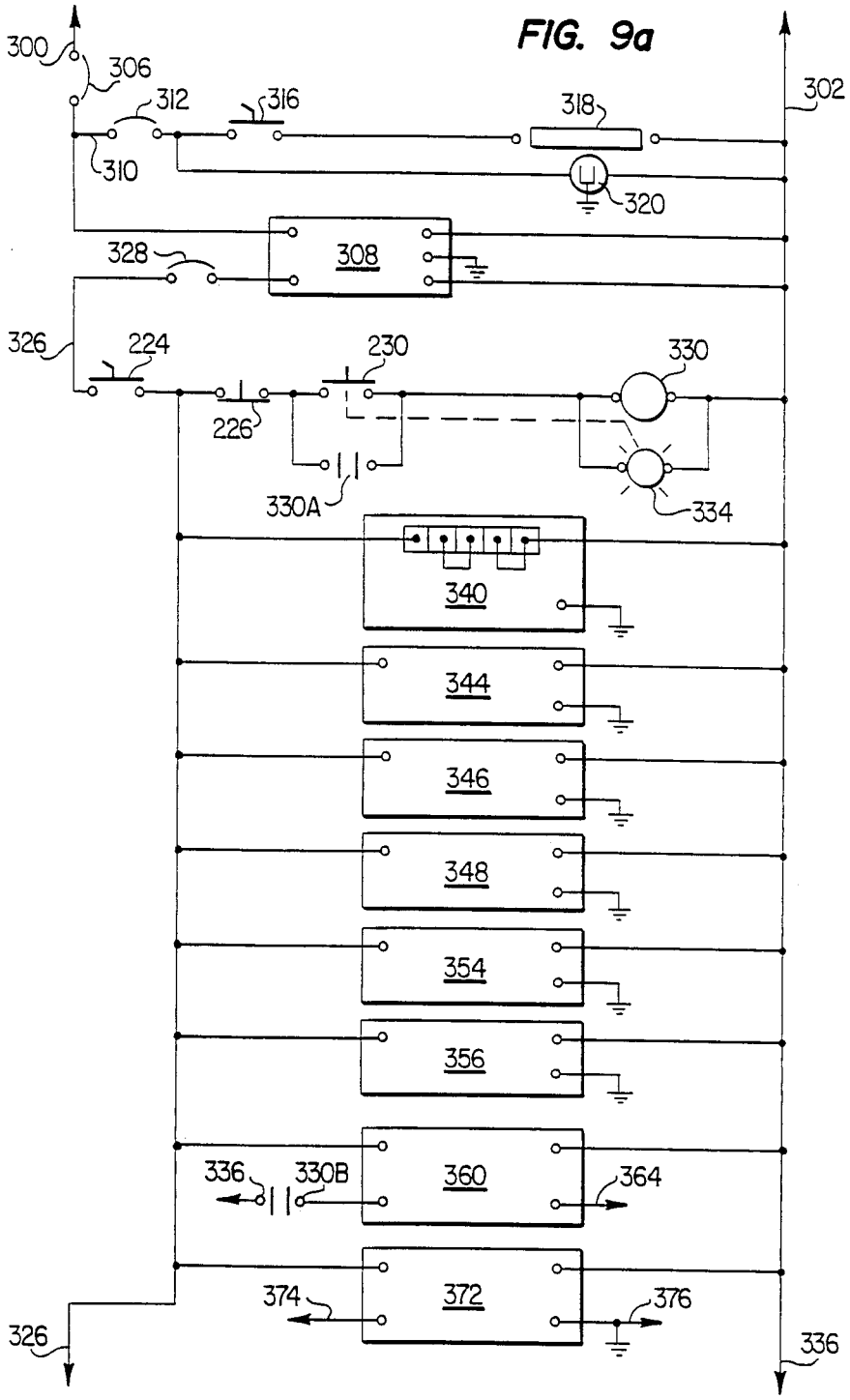
FIGS. 9A–9H depict the circuitry of the automation system for a mixing and dispensing apparatus of FIG. 1.
Figure 9B:
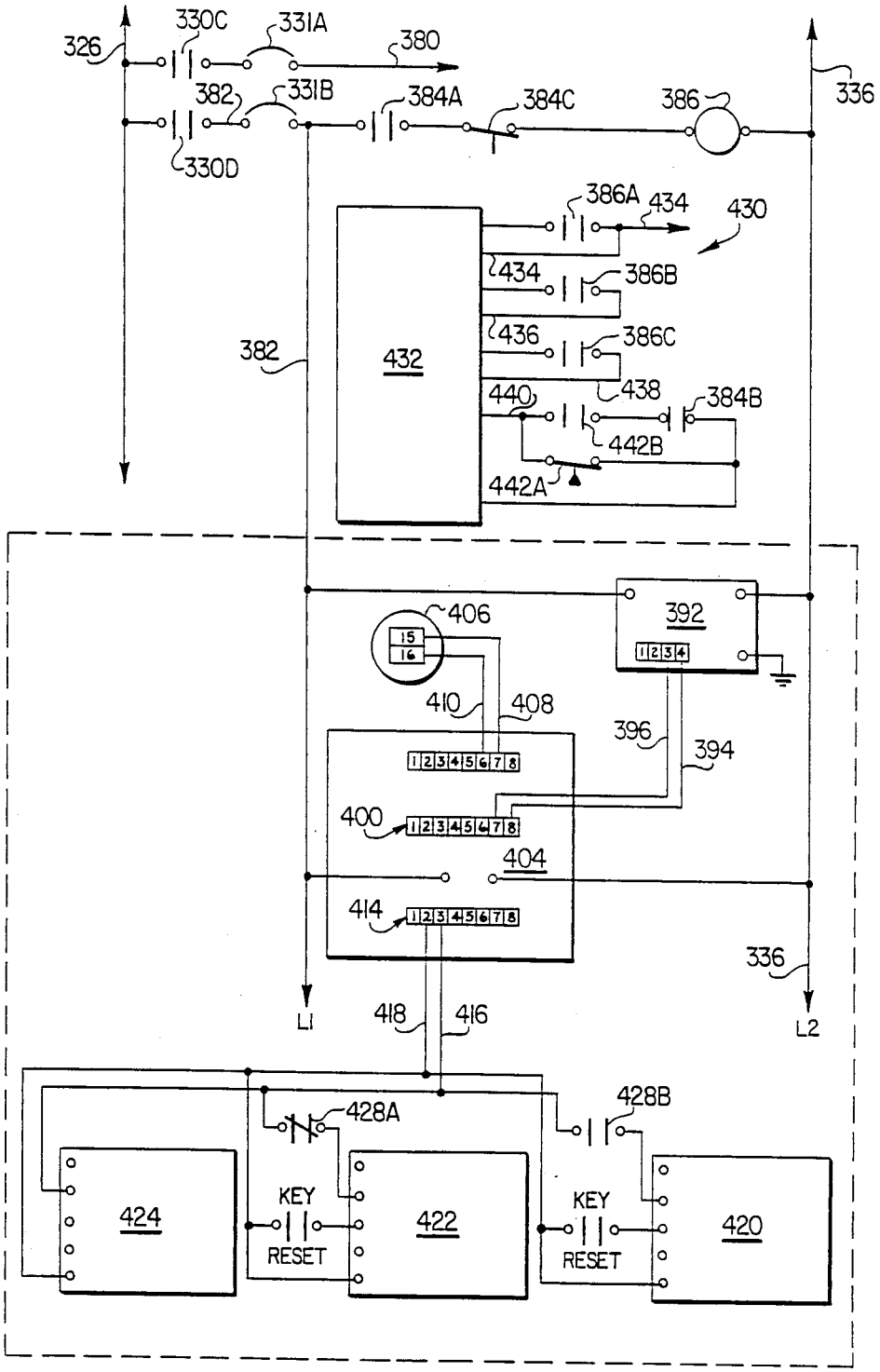
Figure 9C:
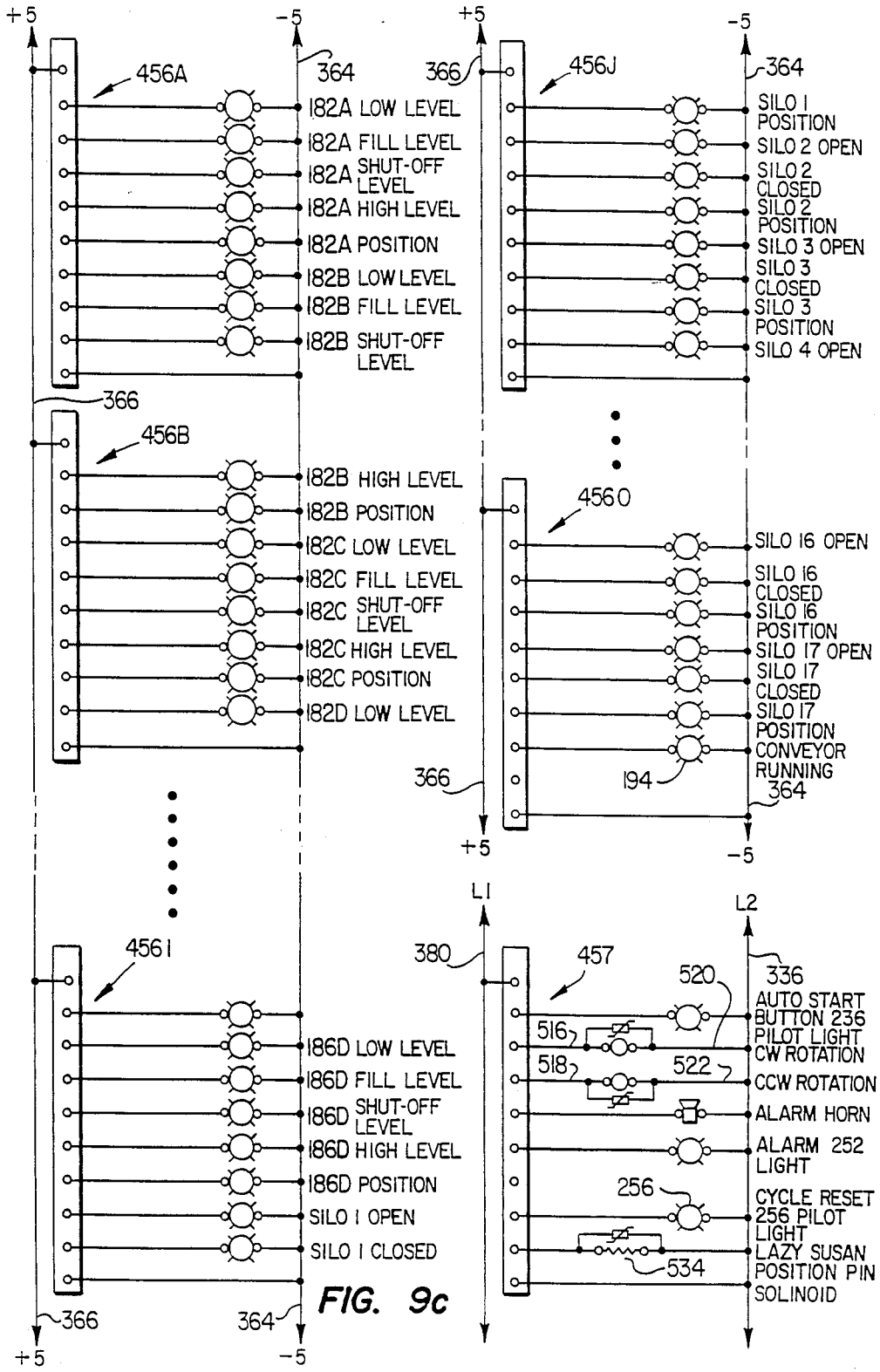
Figure 9D:
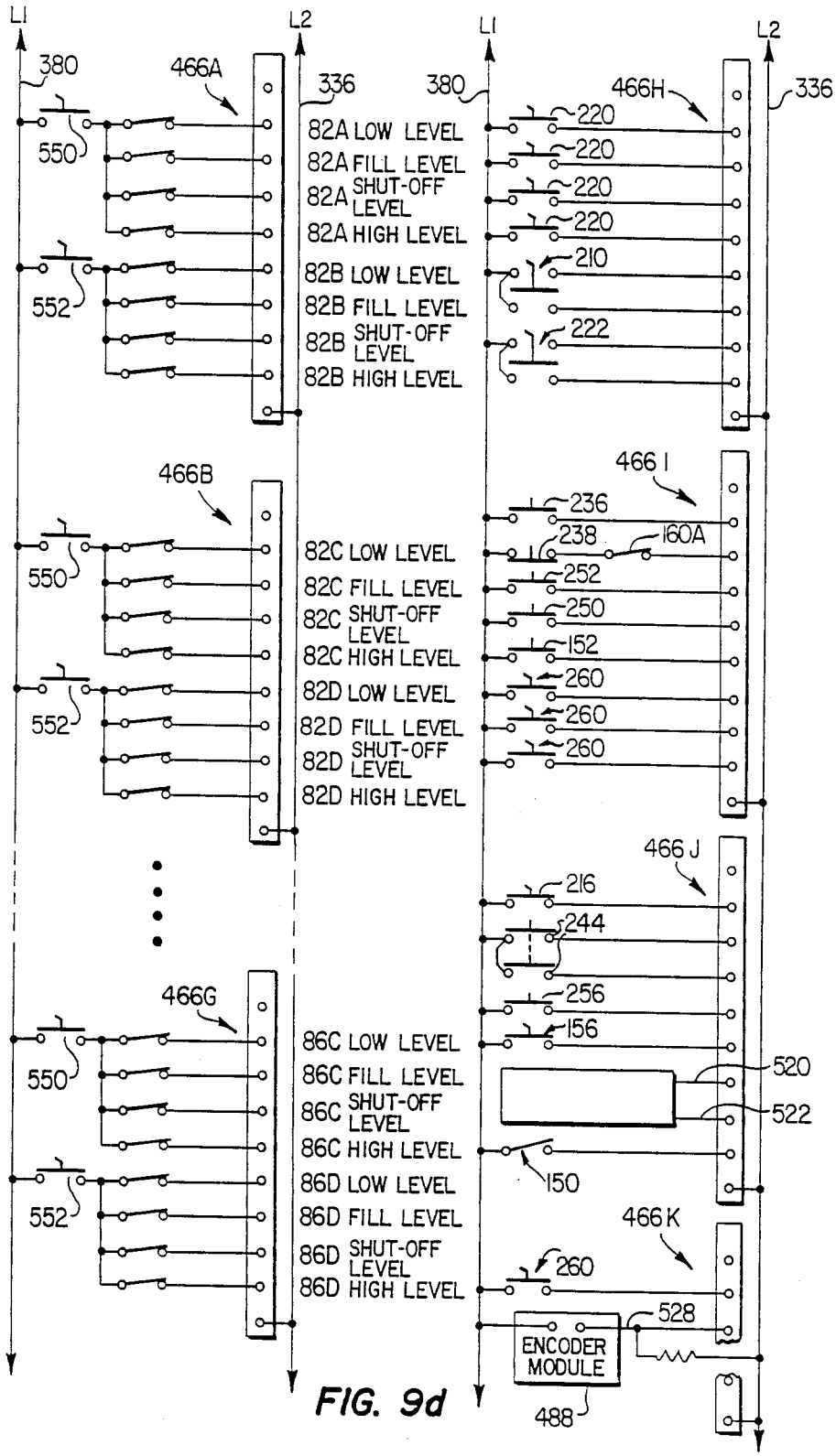

The circumference of the input ports 70 may be provided with a safety rope 160 to stop rotation of the lazy susan 62 by tripping a switch 160A (see FIG. 9D). This is useful when a worker is working on one of the bins and the lazy susan 62 is rotated because of automatic operation of the system. The worker is able to pull the safety rope 160 to stop rotation of the lazy susan 62 and prevent injury.

Figure 5:
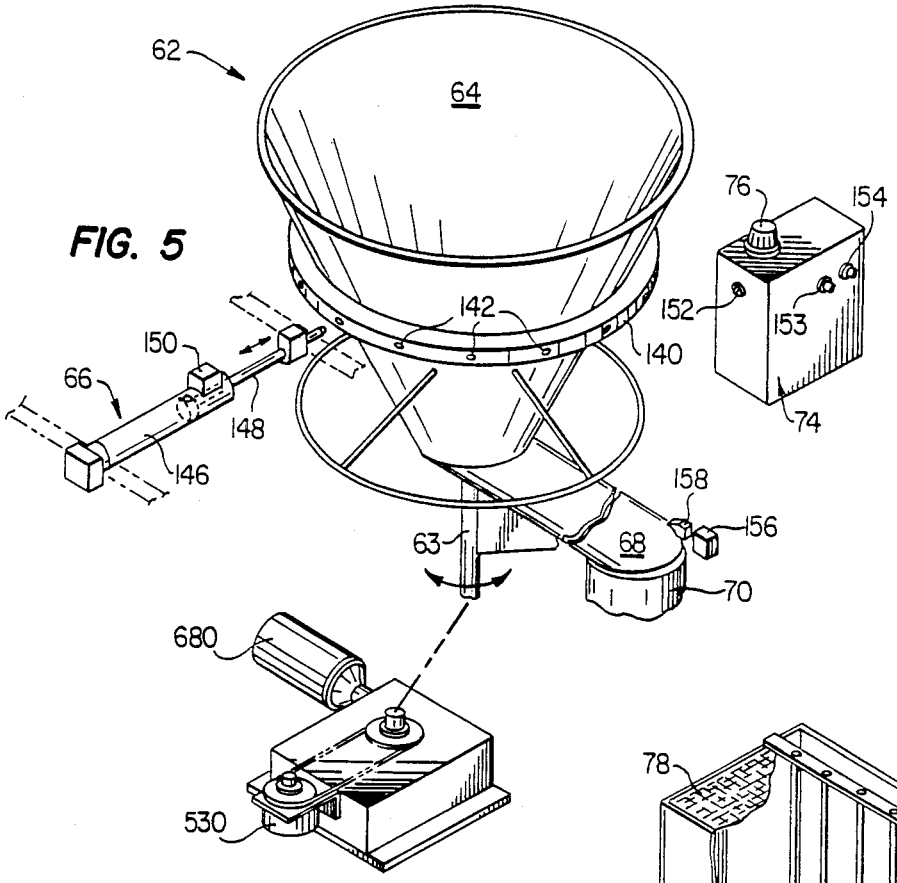
FIG. 5 is a perspective view of the lazy susan, lazy susan control panel, and the lazy susan position pin of FIG. 1.

FIG. 5 shows the lazy susan 62 and positioning rod assembly 66 in greater detail. An annular ring 140 around the circumference of the hopper 64 has several indentations 142 drilled therein. An air cylinder 146 extends and retracts a pin 148. When the sleeve 68 is in a position over the appropriate input port 70, the air cylinder 146 pushes the pin 148 into the proper indention 142. When the pin 148 extends into the indention 142, a positioning switch 150 supplies a signal to the master control system box 36 to so indicate.

The lazy susan control panel 74 with the light 76 thereon is also shown in FIG. 5. The light 76 flashes and an alarm sounds to warn workers in the area when the lazy susan 62 is moving. The lazy susan control panel 74 has drain/fill override, trough clean-out button 152, a bin selection switch 153 and a bin rotation switch 154 mounted thereon. If the automation system is on, the bin selector switch 210 or 212 is set to "drain," and the granules in the dispensing bin 82E or 84E are below the fill level probe 172, pushing the button 152 causes the system to add more granules to the backfill bin (bin 82E or 84E) being used. When the system is in manual, pushing button 152 activates the air jets 58 to clean out the trough 54. The bin selection switch 153 has an "auto" position for automatic operation of the lazy susan 62, an "off" position to deactivate operation of the lazy susan panel 74 and a "manual" position for manual operation of the lazy susan 62. The bin rotation switch 154 is used in conjunction with the "manual" setting on the bin selection switch 153 to manually rotate the lazy susan 62. The bin rotation switch 154 has a clockwise rotation setting and a counterclockwise rotation setting.

Also shown in FIG. 5 is an encoder limit switch 156 that is used to re-zero a lazy susan encoder 530 mounted below the lazy susan 62 and proximate a motor 680 for the lazy susan 62. An activator 158 trips the encoder limit switch 156 each time the sleeve 68 passes by the switch 156. This re-zeros the encoder 530 to increase the accuracy with which the lazy susan 62 delivers the granite color combination to the appropriate input port 70.

Figure 6:
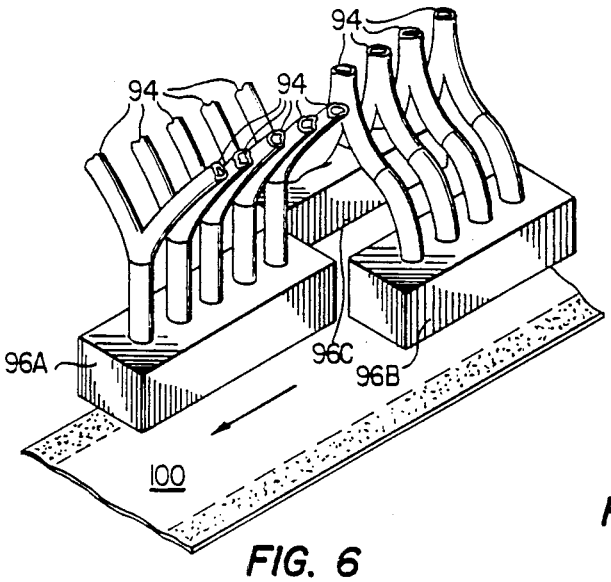
FIG. 6 is a perspective view of the dispensing mechanisms of FIG. 1.

FIG. 6 shows the granule dispensers 96A, 96B and 96C coming out of the hoses 94. The granule dispenser 96A is supplied with granite granules from either the row of bins 82 or the row of bins 84. The granule dispenser 94A dispenses the granite granules onto the asphalt-coated mat 100.

The area of the shingle that is to be covered by other shingles is known as the headlap area. Because the headlap area does not show, it can be any color. Therefore, inexpensive granite granules are used in the headlap area. The granite granules for the headlap of the shingles flow out of the granule dispensing bins 86 into the granule dispensers 96B and 96C. The headlap granules fall on the outer edges of the shingles 100. The asphalt-coated mat 100 is sliced down the middle to form shingles having headlap granules on only one end. Of course, other methods of dispensing the granules known in the art may be used.

Figure 7:
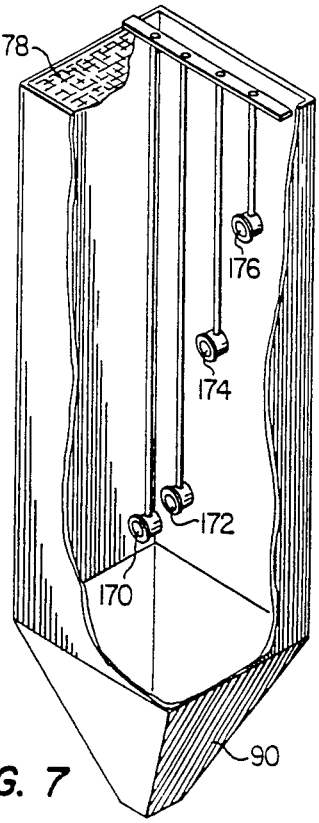
FIG. 7 is a cut-away view of a bin of FIG. 1.

FIG. 7 shows a cutaway view of one of the granule dispensing bins. A low level probe 170, a fill level probe 172, a shut-off level probe 174 and a high level probe 176 extend into each of the granule dispensing bins. The level probes may be any of those known in the art such as the Bantam Bin-dicator model B-1-N.

The high level probe 176 is an overflow indicator that when activated sends a signal to the control circuity to shut-off the granule mixing by closing each of the slide gate dampers 22 and stopping the conveyors 28 and 40 and the bucket elevator 50. Thus, the high level probe 176 prevents spillage due to over-filling the bin.

The shut-off level probe 174, when activated, sends a signal to the control circuitry that the bin is sufficiently filled. After receiving such a signal, the control circuitry closes the slide gate dampers 22 in an orderly fashion, activates the air jet 58 and stops the conveyors 28 and 40 and bucket elevator 50 after the remaining granite granules have been conveyed to the lazy susan 62 and into the bin so that the system may prepare for mixing a new color combination and transporting it to a different granule dispensing bin.

The fill level probe 172, when activated, signals the control circuitry to indicate that the granule dispensing bin is low on granite granules. The signal from the fill level probe 172 causes the control circuitry to refill the granule dispensing bin involved with the appropriate granite color combination. If the color combination in a bin drops below the low level probe 170, an alarm sounds and an indicator light 183E flashes so that the workers at the plant are able to correct the problem.

Figure 8:
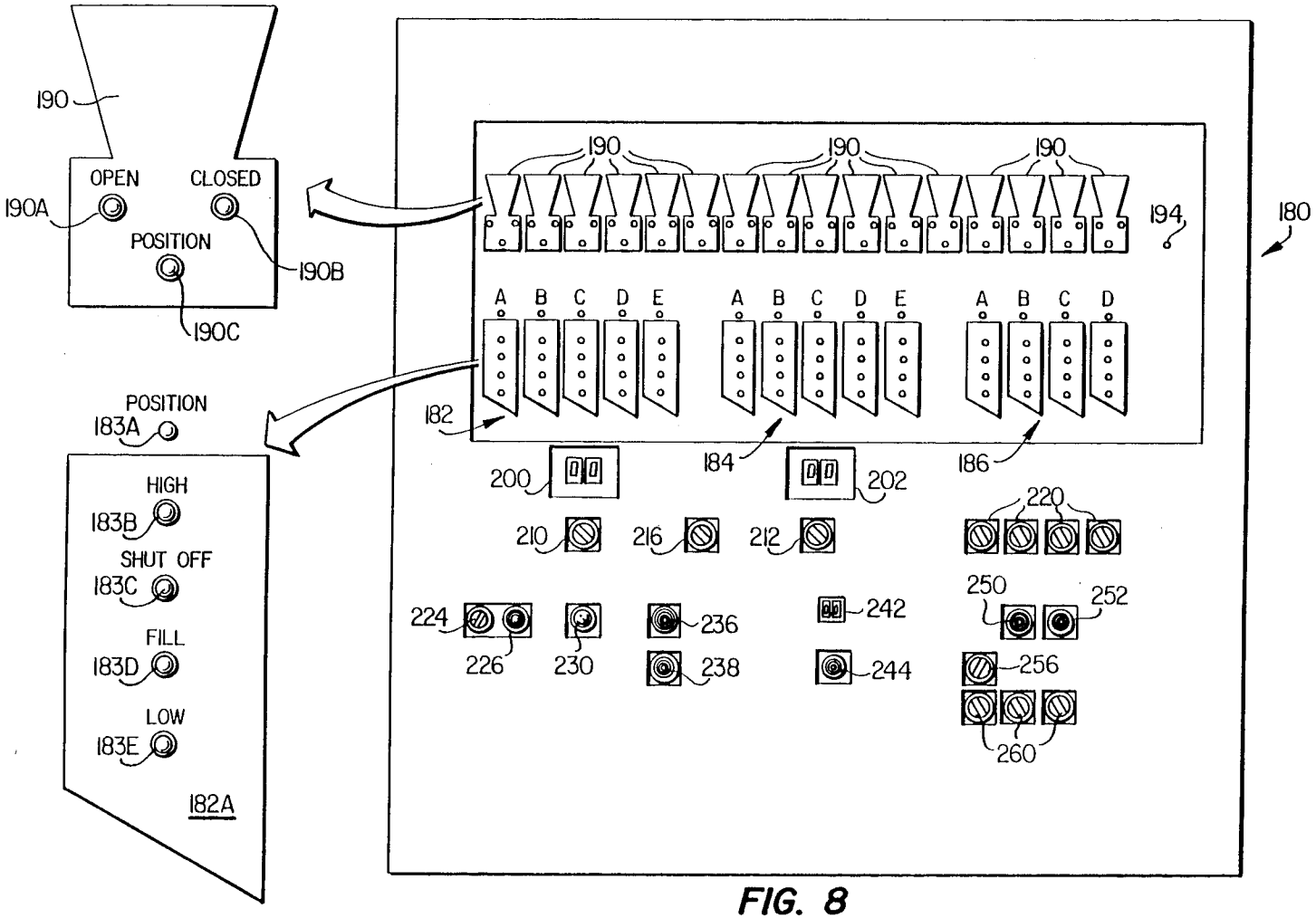
FIG. 8 depicts the main control panel of FIG. 1.

FIG. 8 is a close-up view of a master control panel 180 on the main control system box 36. In the middle of the master control panel 180 are indicator light assemblies 182, 184 and 186. The indicator light assemblies 182, 184 and 186 show what signal is being sent from the low level probe 170, fill level probe 172, shut-off level probe 174 and high level probe 176 in each of the bins of the granule dispensing bin assembly 80. In FIG. 8, the indicator light assemblies are numbered to correlate with the particular granule dispensing bin of the bin assembly 80. Thus, the indicator light assembly 182 has an indicator light row 182A, 182B, 182C, 182D or 182E for each of the granule dispensing bins 82A, 82B, 82C, 82D or 82E, respectively. The indicator light assembly 184 has an indicator light row 184A, 184B, 184C, 184D or 184E for each of the granite granule dispensing bins 84A, 84B, 84C, 84D or 84E, respectively. The indicator light assembly 186 has an indicator light row 186A, 186B, 186C or 186D for each of the granite granule dispensing bins 86A, 86B, 86C or 86D, respectively.

The top-most light 183A of each of the indicator light rows is a position light to show the position of the sleeve 68 of the lazy susan 62. This light is on when the sleeve 68 is properly in position over the input port 70 of that bin. The light flashes and an alarm goes off if the sleeve is not in the proper position.

The lower four lights 183B, 183C, 183D and 183E indicate that a signal is being received from the high level probe 176, the shut-off level probe 174, the fill level probe 172 and the low level probe 170, respectively, of that bin. Thus, if an individual light is on, the granules in the bin are at the level of the probe or above.

The indicator light assemblies 190 on the top of the master control panel 180 comprise three lights 190A, 190B and 190C as shown on the left of FIG. 8. The indicator light assemblies 190 correlate with individual silos 12 and the valve assemblies 20 of the respective silos. When the "open" light 190A is on in an indicator light assembly 190, the slide gate damper 22 for that particular silo is in the open position. When the "closed" light 190B is on, the slide gate damper 22 is closed. When the "position" light 190C is on, the proportion gate 24 is set in the proper position for the particular granite color combination being mixed at that particular time. The lights 190A, 190B and 190C in indicator light assembly 190 flash to show an alarm condition when either the slide gate damper 22 or proportion gate 24 is not in the proper position.

To the right of the indicator light assemblies 190 is a conveyor light 194. When the conveyors are running, the conveyor light 194 is lit. The conveyor light 194 flashes if the conveyor 28 is not running when it should be.

Just below the bin indicator light assemblies 182 and 184 are two color indicators 200 and 202. The number displayed by the color indicator 200 indictates the shade of shingle to be made by the color combinations to be loaded in the bins 82. Likewise, the color indicator 202 indicates the shingle shade for the color combinations held in granule dispensing bins 84. The granule dispensing bins 86 do not have a color indicator because those bins contain headlap, which may be any color.

Beneath the color indicators 200 and 202 are bin blend selector switches 210 and 212. The bin blend selector switch 210 has an off position, a drain position and a run position. The off position is used to turn off the group of granule dispensing bins 82 so that a shingle shade number may be set for that group of bins or to deactivate that group of bins.

The drain position is used to restrict the fill of the granule dispensing bins 82 when a color change is desired. The drain position allows the back fill bin 82E to refill one time and then run down. The other bins 82 have short duration refills until the back fill bin 82E falls below the level of its fill level probe 172. An alarm sounds and a low level light 183E flashes when the level of granite granules in any of the bins 82 falls below its respective low level probes 170 when the bin blend selector switch 210 is set to "run" or "drain."

The run position is used for automatic operation of the granule dispensing bins 82. Bins are refilled when the level falls below the bin fill level probe 172. If other bins 82 are being filled, the bins are filled on a priority basis. The bin blend selector switch 212 operates in the same fashion with the same functions and positions except that it relates to the bins 84 rather than the bins 82.

Between the bin blend selector switches 210 and 212 is a bin selector switch 216 that has two positions to select the group of granule dispensing bins 82 or 84 to be used for the shade of shingle being run. This sets the fill priority and allows the group of bins not being used to be filled for the next run of a different shade of shingle but with a lower priority than the priorities of the bins being run.

Four headlap bin selector switches 220 activate the four headlap granule dispensing bins 86 during automatic operation. A bin refills when the level drops below the fill level probe 172 of that particular bin. An alarm sounds if the bin is activated and the level drops below the low level probe 170 to warn the operator and to permit the operator to switch to a different headlap bin if necessary.

A system power switch 224 on the left side of the master control panel 180 is used to turn on all of the system power except for an interior fluorescent panel light 318 and a plug receptacle 320 (discussed with respect to FIG. 9A below). Next to the system power switch 224 is an emergency stop push button 226 which is used to drop out an emergency stop relay 330 (see FIGS. 9A and 9B) providing power to all inputs and outputs.

A system power reset button 230 is used to reset the emergency stop relay 330. The reset button 230 has a pilot light 334 (see FIG. 9A) that is lit when the relay is activated. Reset button 230 must be reset to provide power for manual or automatic operation of the blend system after a power failure or on start-up after a shutdown.

An auto start button 236 and an auto stop button 238 are used to start the automatic mode of the granule blend system and to stop the automatic operation, respectively. The auto start button 236 must be reset after power failures, emergency stops and shutdown.

A color code input switch 242 and a blend select switch 244 operate in tandem to select the blend color for the shade of shingle to be manufactured from the granite granules held in a group of granule dispensing bins 82 or 84. The blend select switch 244 has two positions, one indicating the granule dispensing bins 82 and the other indicating the granule dispensing bins 84. The blend select switch 244 is set to the proper bins 82 or 84 for which the color is to be changed. The blend selector switch 210 or 212 is set to "off." The color code input switch 242 is a thumbwheel switch that is adjusted to input the color code for the shingle shade selected. After the color code is selected, a button on the blend select switch 244 is pushed and the color code is loaded and displayed on the digital readout of the appropriate indicator 200 or 202. The automation system then loads the appropriate color combinations of granite granules into the proper granule dispensing bins. The color remains loaded until it is changed by repeating this procedure for a different color code.

The master control panel 180 has a lights test push-button 250 to make sure all of the lights are properly operating. Next to the push-button 250 is an alarm acknowledge button 252 that is pushed to silence the alarm. A cycle reset push-button 256 is used to reset the automatic cycle when a malfunction has occurred. A pilot light on the push-button 256 is lit when the cycle is reset to home position.

Finally, master control panel 180 can be provided with any number of multiple silo selector switches 260. Very common colors of granite granules are often put into two or more different silos. For each such color, the master control panel is provided with a silo selector switch 260 to elect the silo to use for that color of granite granules. The system could be programmed to use a signal from a low level probe in a dual silo 12 to automatically switch to the alternate silo 12.

Referring now to FIG. 9A, external power leads 300 and 302 supply power to the circuitry of the automation system for the mixing and dispensing apparatus. Lead 300 supplies power through a main circuit breaker 306 into a filter 308. The filter 308 is a line load filter such as is known in the art.

A lead 310 is connected through a circuit breaker 312 and a light switch 316 to the fluorescent panel light 318 in the main control box 36. The plug receptacle 320 is also connected in the main control box 36. The fluorescent panel light 318 provides light to the interior of the main control box 36 and the receptacle plug 320 provides a power source for instruments and equipment used in working on the control box 36.

From the filter 308 a lead 326 is connected to a circuit breaker 328 and to the system power switch 224. The emergency stop push button 226, the system power reset button 230, the emergency stop relay 330, a contact 330A for the emergency stop relay 330, and the pilot light 334 are connected between the lead 326 and a lead 336. The emergency stop relay 330 also has contacts 330B (shown in FIG. 9A), 330C and 330D (shown in FIG. 9B).

The leads 326 and 336 are connected to a programmable controller 340, which may be any of those known in the art such as the Allen-Bradley PLC-2/30 programmable controller. The programmable controller 340 is programmed to control the automation system components, and a sample program is attached hereto as Exhibit A. The leads 326 and 336 are connected to an auxiliary power supply 344, an auxiliary power supply 346 and an auxiliary power supply 348. The auxiliary power supplies 344, 346 and 348, used to supply power to the input/output racks, may be any of those known in the art such as the Allen-Bradley auxiliary power supply 1771-P2. Also supplying power are analog module power supplies 354 and 356 which are, for instance, Allen-Bradley auxiliary power supplies 1770-P1.

Lead 326 connects to a power supply 360 which may be any of those known in the art such as the Sola power supply 83-05-260-2. From the power supply 360 extends a negative 5-volt direct current lead 364 and a positive 5-volt direct current lead 366 through the emergency stop relay contact 330B. The connections leads 364 and 366 make are discussed in more detail with regard to FIGS. 9C and 9E below.

At the bottom of FIG. 9A is shown a power supply 372 which may be any of those known in the art such as the "acdc electronics" Model No. ECV12N1.7. From the power supply 372 extends a positive 12 volt direct current lead 374 and a negative 12 volt direct current lead 376. These leads are connected to the lazy susan encoder 530 as discussed with regard to FIG. 9E.

Referring now to FIG. 9B, the lead 326 is split into leads 380 and 382 which pass through the emergency stop relay contacts 330C or 330D and through circuit breakers 331A and 331B. Lead 38 is connected to circuitry as discussed with reference to FIGS. 9D, 9E, 9F and 9G. Lead 382 is connected through conveyor start relay contacts 384A and 384C to an auxiliary start relay 386 and to lead 336.

Lead 382 and lead 336 are also connected to the circuitry for the scale 44 which is mounted in the remote panel 48. The circuitry for the scale 44 is enclosed by dashed lines in FIG. 9B. The lead 382 connects to a scale detector 392 which is connected through leads 394 and 396 to a detector input/output 400 mounted on a transmitter 404. A tach generator 406 is connected to the transmitter 404 through leads 408 and 410. A relay output 414 is connected through leads 416 and 418 to a headlap counter 420, a blended granule counter 422 and a total counter 424. The scale detector 392, detector input/output 400, transmitter 404, tach generator 406 and relay output 414 are all components of the scale 44. The counters 420, 422 and 424 may be any of those known in the art such as the Red Line Cub 2 counter sold by Red Line Controls of York, Pennsylvania.

Figure 9E:
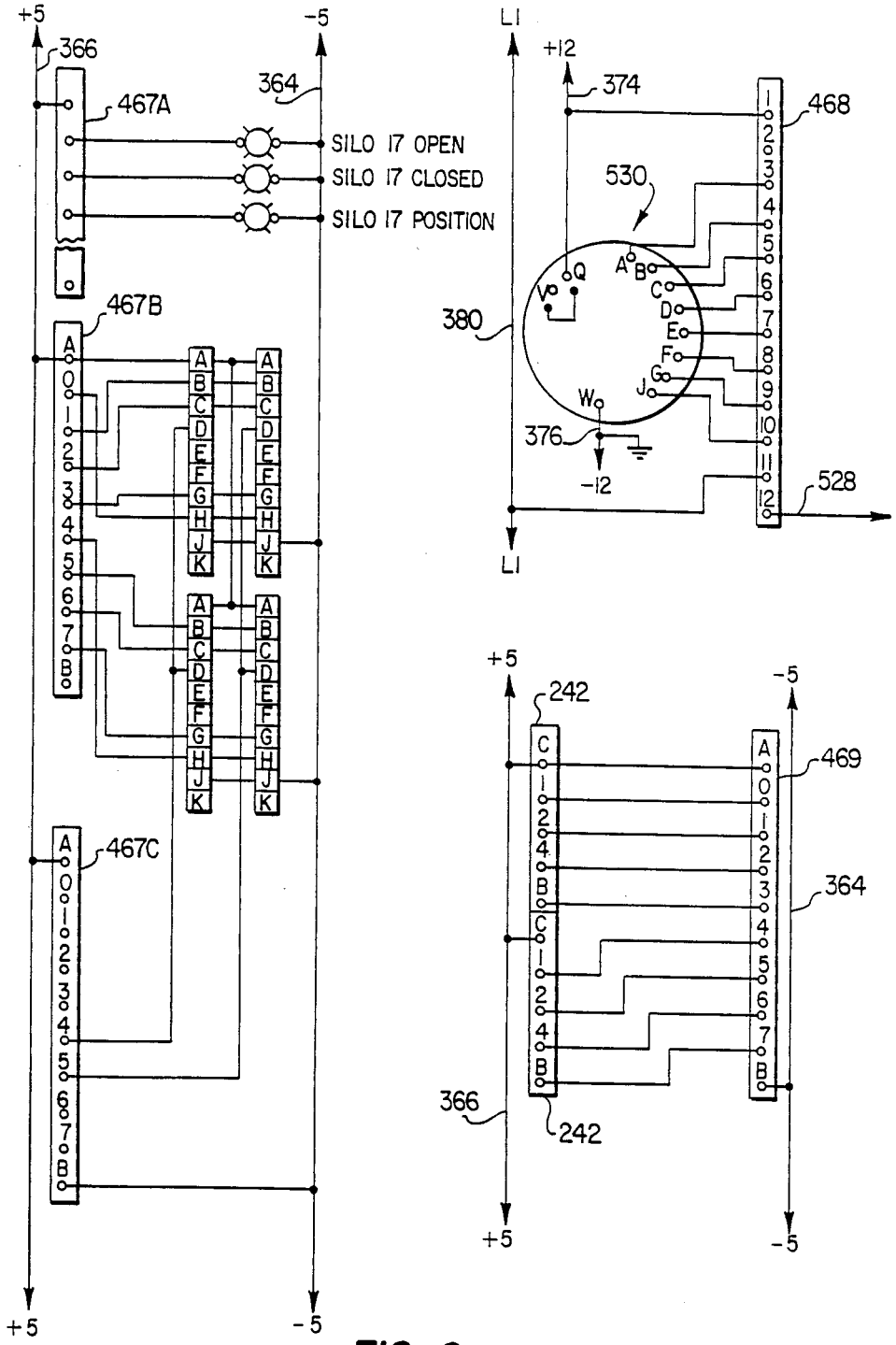
Figure 9F:
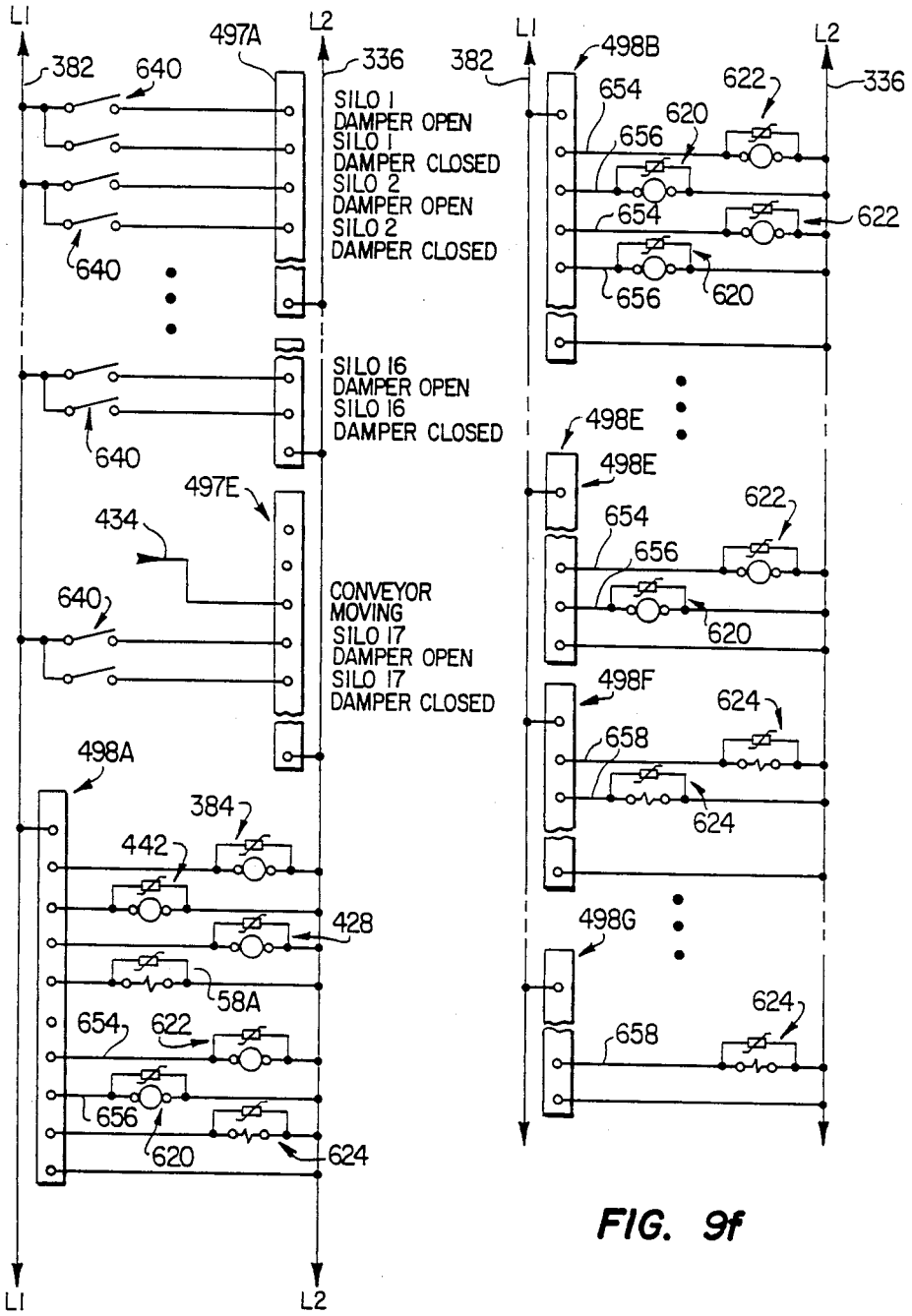

Two headlap relay contacts 428A and 428B in the circuitry are contacts for a headlap relay 428 depicted in FIG. 9F. The headlap relay 428 indicates to the headlap counter 420 the weight of headlap granules that have been transmitted over the scale 44.

Also shown in FIG. 9B is a granule conveyor interlock circuitry system 430 that produces a time delay to sequentially start the bucket elevator 50, conveyor 40 and the conveyor 28. The circuitry system 430 comprises a conveyor start/stop panel 432 having leads 434, 436, 438 and 440 extending therefrom. Auxiliary start relay contacts 386A, 386B and 386C are in the leads 434, 436 and 438, respectively, and are controlled by the auxiliary start relay 386. The lead 440 contains a conveyor start relay contact 384B for the conveyor start relay 384 and two auto relay contacts 442A and 442B for an auto relay 442 (see FIG. 9F) as shown. The lead 434 is also connected to an input module 497E shown in FIG. 9F.

Figure 9G:
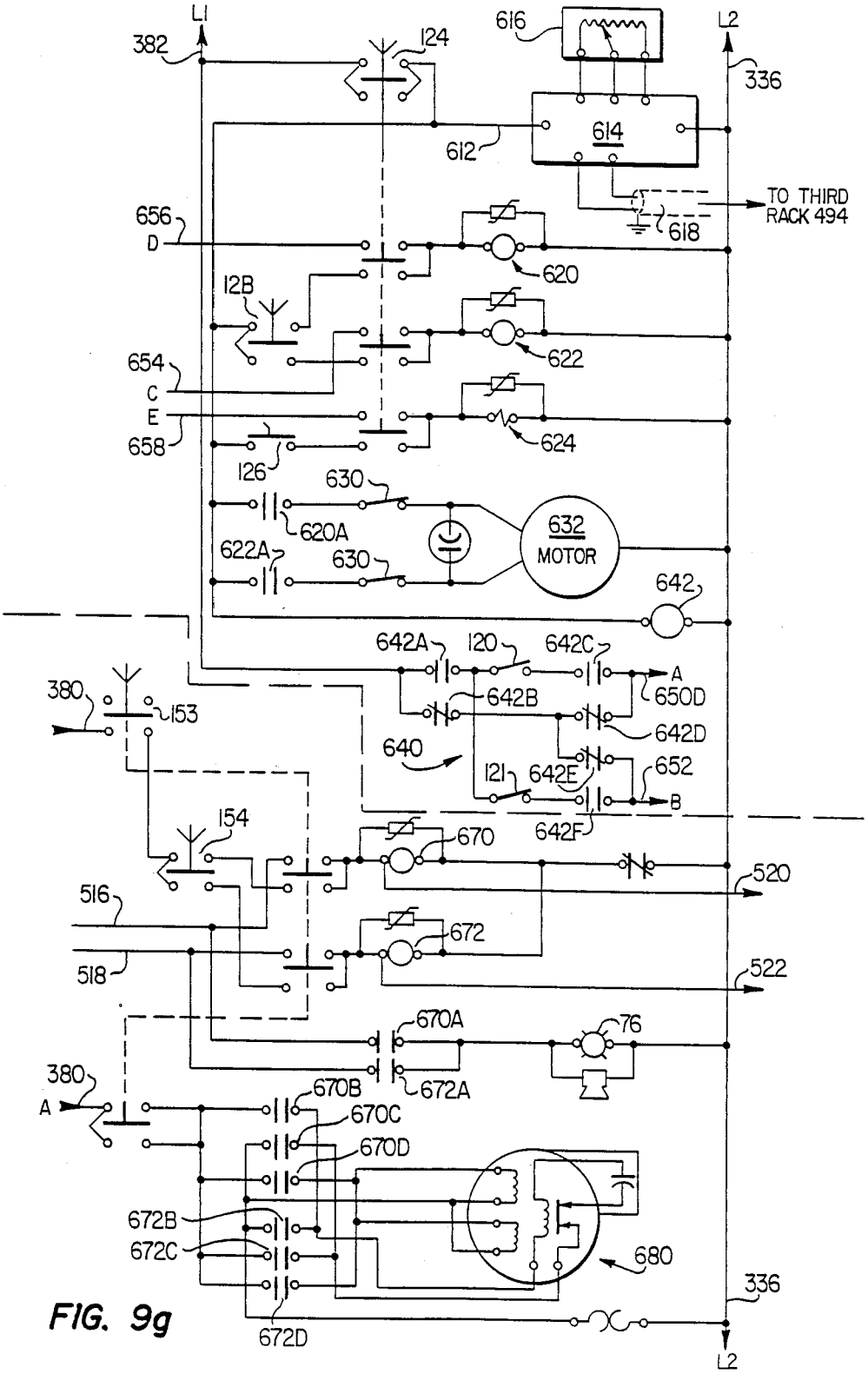
Figure 9H:
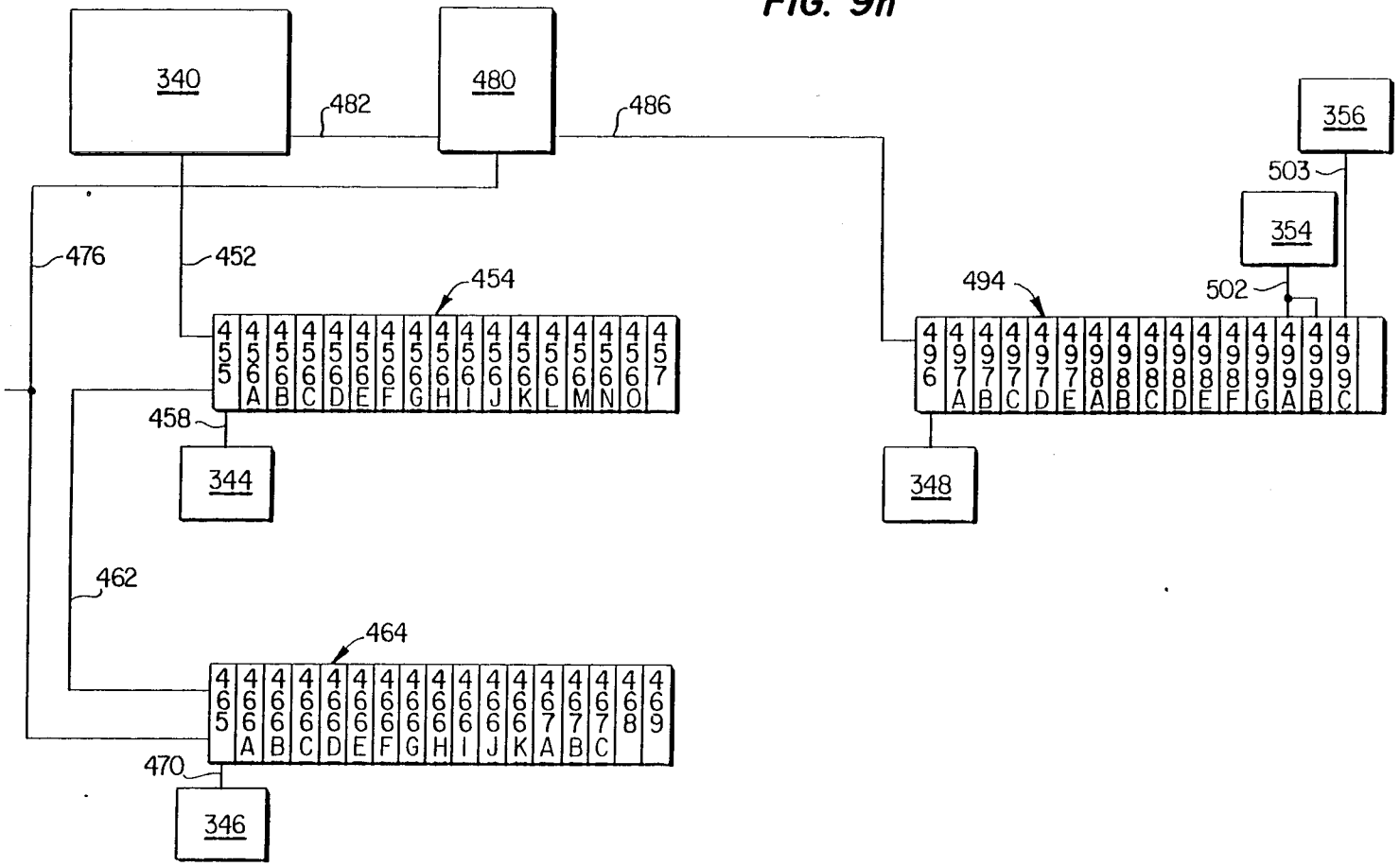

FIG. 9H schematically shows the interconnect cable circuitry of the present invention. The programmable controller 340 communicates via a cable 452 with a first local rack 454 through a local input/output adapter 455. The rack is comprised of 15 TTL output module assemblies 456A through 456O, and an AC (120 v) output module 457. The power supply 344 (see FIG. 9A) is connected to the first rack 454 through a power cable 458.

A cable 462 connects the first rack 454 to a second local rack 464. The second rack 464 comprises a local input/output adapter 465, eleven AC/DC (120 v) input modules 466A through 466K, three TTL output module assemblies 467A, 467B and 467C, an absolute encoder input module 468 and a TTL input module 469. The power supply 346 (see FIG. 9A) is connected to the second rack 464 by a cable 470. A cable 476 connects the second rack 464 to a remote scanner 480 which is also connected to the programmable controller 340 by a power supply cable 482.

The remote scanner 480 is connected through a cable 486 to a third remote rack 494 which is powered by the power supply 348 (see FIG. 9A). The third rack 494 is contained in the remote panel 48 and comprises a remote input/output adapter 496, five AC/DC (120 v) input modules 497A through 497E, seven AC (120 v) output modules 498A through 498G and three 4-to-20 milliamp 8-bit analog input modules 499A, 499B and 499C. The analog input modules 499A and 499B are powered by the power supply 354 through cable 502 and the analog input module 499C is powered by the power supply 356 through cable 503. The analog input module 499C and the power supply 356 are only needed because there are more than 16 silos. Without a 17th silo the analog input module 499C and the power supply 356 are not required.

The local input/output adapters 455 and 465 may be any of those known in the art such as the Allen-Bradley catalog No. 1771-AL. The TTL output modules 456A through 456O and 467A through 467C may be any of those known in the art such as the Allen-Bradley catalog No. 1771-OG. The AC (120 v) output modules 457 and 498A through 498G may be any of those known in the art such as the Allen-Bradley catalog No. 1771-OA. The AC/DC (120 v) input modules 466A through 466K and 497A through 497E may be any of those known in the art such as the Allen-Bradley catalog No. 1771-IA. The absolute encoder input module 468 may be any of those known in the art such as the Allen-Bradley catalog No. 1771-DL. The TTL input 469 may be any of those known in the art such as the Allen-Bradley catalog No. 1771-IG. The remote scanner 480 may be any of those known in the art such as the Allen-Bradley catalog No. 1772-SD2. The remote input/output adapter 496 may be any of those known in the art such as the Allen-Bradley catalog No. 1771-AS. The analog input modules 499A, 499B and 499C may be any of those eight bit modules known in the art such as the Allen-Bradley catalog No. 1771-IE.

Referring now to FIG. 9C, leads 364 and 366 from the power supply 360 (see FIG. 9A) supply a 5-volt potential to the TTL output modules 456A to 456O (see FIG. 9H) of the first rack 454. The TTL output modules 456A to 456I provide an output to the indicator light assemblies 182, 184 and 186 on the master control panel 180 for each of the bins 82, 84 and 86 described with regard to FIG. 8. As shown in FIG. 9C, the top indicator light is for the low level light 183E in the indicator light row 182A described with reference to FIG. 8. The next light is the row 182A fill level light 183D, then the row 182A shut-off level light 183C, then the row 182A high level light 183B and then the row 182A position light 183A. The circuitry is sequential so that the assembly 456B begins with the row 182B high level light 183B and also provides an output to the row 182D low level light 183E. The modules 456C through 456H are not shown but continue with the same pattern. The TTL output module 456I completes the indictator light circuitry for the indicator light assemblies 182, 184 and 186.

The TTL output module 456I also provides a signal to the "open" light 190A and the "closed" light 190B in the light assembly 190 for the first silo. The right side of FIG. 9C shows the sequence of the indicator lights in the assemblies 190 which are controlled by TTL output modules 456J through 456O. The last output for the TTL output module 456O controls the conveyor running indicator light 194.

Also shown in FIG. 9C is the AC (120 v) output module 457 from the first rack 454 which is connected between the leads 380 and 336. The AC (120 v) output module 457 provides a signal to a pilot light for the auto start button 236. The signal to effect clockwise rotation and counterclockwise rotation of the lazy susan 62 is provided by AC (120 v) output module 457 via leads 516 and 518. However, the complete circuitry for this function is not shown in FIG. 9C but is shown in more detail in FIG. 9G. The AC (120 v) output module 457 also controls an alarm horn, a pilot light for the alarm acknowledge button 252, a pilot light for the cycle reset push-button 256, and a lazy susan position solenoid 534 that operates the positioning rod assembly 66.

Referring now to FIG. 9D, AC/DC (120 v) input modules 466A through 466K are shown connected between leads 380 and 336. The AC/DC (120 v) input module 466A is provided with the signals from the switches for the low-level probe 170, the fill level probe 172, the shut-off level probe 174, and the high-level probe 176 for the bins 82A and 82B. The switches 550 and 552 are mounted in the lazy susan control panel 74 and are used to disconnect power to the level probes 170, 172, 174 and 176 so the bin can be worked on while the system is operating. This open circuit prevents the bin from being filled. The signals from the remainder of the level probes are applied to the AC/DC (120 v) input modules 466B through 466G.

The AC/DC (120 v) input module 466H accepts the signals from the headlap bin selector switches 220 for the headlap granule dispensing bins 86A through 86D and from the bin blend selector switches 210 and 212. The auto start button 236, the auto stop button 238 and the switch 160A for the safety rope 160, the alarm acknowledge button 252, the lights test push-button 250, the drain/fill override-elevator clean-out button 152 (see FIG. 5), and three silo selector switches 260 are connected to apply signals to the AC/DC (120 v) output module 466I. The AC/DC (120 v) input module 466J receives the signals from the bin selector switch 216, the blend select switch 244, the cycle reset push-button 256, the encoder limit switch 156 (see FIG. 5), the lazy susan position pin limit switch 150 (see FIG. 5) and the clockwise and counterclockwise rotation signal from the lazy susan control circuit (see FIG. 9G) distributed from leads 520 and 522.

An additional silo selector switch 260 applies a signal to AC/DC (120 v) input module 466K. Signals from the lazy susan zero speed output on the lazy susan encoder 530 (see FIG. 9E) are applied to the AC/DC (120 v) input module 466K via a lead 528 from the absolute encoder input module 468. The zero speed output applies a signal to the lead 528 when the lazy susan 62 should be rotating but the lazy susan encoder 530 is not receiving a changing reading (for example, when the lazy susan 62 is stuck). When such a signal is received in the AC/DC (120v) input module 466K, operation of the lazy susan 62 is stopped to prevent an overload and an alarm is sounded because of the automatic shutdown.

Referring now to FIG. 9E, leads 364 and 366 supply power to the TTL output modules 467A, 467B and 467C. Module 467A operates the indicator lights for the panel 190 for the 17th silo. TTL output modules 467B and 467C provide outputs to a multiplex circuit for the two color indicators 200 and 202 on the master control panel 180.

As shown in FIG. 9E, the lazy susan encoder 530 is connected to the leads 374 and 376 from the power supply 372 (see FIG. 9A). The absolute encoder input module 468 is connected to leads 380 and 528. The lazy susan position encoder 530 determines the location of the sleeve 68 and applies an output signal indicating that location to the absolute encoder input module 468.

The TTL input module 469 receives the signals from the color selector (thumbwheel) switch 242 that indicates what shades of shingles are to be run and thus what color combinations are to be loaded into the bins by the automation sysem. In the drawing shown in FIG. 9E, signals for the tens digits are received by the lower portion of the TTL input module 469 and signals for the units digits are received by the upper portion. Referring now to FIG. 9F, the AC/DC (120 v) input modules 497A through 497E are connected between the leads 336 and 382. These modules accept the input signals of limit switch assemblies 640 for the open and closed limit switches 120 and 121 on the slide gate dampers 22 on the individual silos. The circuitry for a single assembly 640 is shown in more detail in FIG. 9G. Each silo has a slide gate damper 22 and each has a lead 650 and a lead 652 to provide the required signal to the respective AC/DC (120 v) input modules 497A through 497E. The AC/DC (120 v) input module 497E also receives a signal indicating movement of the conveyor 28 through a lead 434 in the conveyor start/stop 430 panel (See FIG. 9B).

The AC (120 v) output module 498A applies signals to the conveyor start relay 384, an auto relay 442 for the conveyor start/stop panel 432, a headlap relay 428 (see FIG. 9B) and a solenoid valve 58A fr activating the air jets 58. The remainder of the AC (120 v) output modules 498A through 498E provide outputs to positioner open relays 622 and positioner close relays 620 which control the opening and closing of each of the proportion gates 24 through the linear actuators 112 shown in FIG. 2. The AC (120 v) output modules 498F and 498G provide output signals to solenoids 624 which activate the slide gate dampers 22 of each of the silos. The relays 622 and 620 and solenoid 624 for silo 17 are connected to the AC (120 v) output module 498A. The circuitry for the position open relay 622, position close relay 620 and solenoid 624 for one silo is shown in detail in FIG. 9G.

Each of the silo control panels has the same circuitry to control its respective slide gate damper 22 and proportion gate 24. Referring now to the top of FIG. 9G, the silo selector switch 124 is connected by a lead 612 to a transmitter 614. The transmitter 614 sends signals to the corresponding analog input module 499A, 499B or 499C via a cable 618 to indicate the position of the proportion gates 24 based on the feedback from the potentiometer 616 inside the linear actuator 112. Adjustments are made by the linear actuators 112 to adjust the position of the proportion gates 24 if necessary. The proportion indicator 122 is a component of the transmitter 614. The transmitter 614 can be any of those known in the art such as the Newport Quanta Q 2040-N panel meter.

A positioner close relay 620 and a positioner open relay 622 (see FIG. 9F) operate to close and open the proportion gate 24. The lead 612 is connected to the slide gate selector switch 126 and the position selector switch 128. A gate valve solenoid 624 (also shown in FIG. 9F) opens or closes the slide gate damper 22. The lead 612 is connected through a close relay contact 620A and an open relay contact 622A to a motor 632 which drives the linear actuator 112 to move the proportion gate 24. Limit switches 630 are included in the circuitry to stop the linear actuator 112 when the proportion gate 24 is completely open or completely closed.

Also connected to the lead 382 is the limit switch assembly 640 which supplies a signal through leads 650 and 652 to the respective AC/DC (120 v) input modules 497A through 497D (see FIG. 9F). When the silo selector switch 124 is in the "off" position, the limit switch assembly 640 signals the programmable controller 340 via leads 650 and 652 that the slide gate damper 22 is both open and closed. The controller 340 can be programmed to interpret this to mean the silo panel is turned off. When the switch 124 is in the "automatic" or "manual" position, a limit switch relay 642 trips the limit switch relay contacts 642A, 642B, 642C, 642D, 642E and 642F in the assembly 640. This closes the normally open contacts 642A, 642C and 642F and opens the normally closed contacts 642B, 642D and 642E. The result is that when the open limit switch 120 on the air cylinders 118 is closed, a signal is sent via lead 650 to the respective AC/DC (120 v) input modules 497A through 497D. When the closed limit switch 121 is closed, a signal via lead 652 is provided to the modules.

The lead 658 for silo 1 provides a signal from the AC (120 v) output module 498F shown in FIG. 9. This signal activates the solenoid 624 to open or close the slide gate damper 22.

When the proportion gate 24 for silo 1 needs to be opened, a signal is supplied to the silo control panel circuitry via the lead 654 shown with regard to AC (120 v) output module 498B in FIG. 9F. The signal is applied to the open relay 622 which closes the open relay contact 622A and the motor 632 opens the proportion gate 24. When the proportion gate 24 of silo 1 is to be closed a signal is provided from the AC (120 v) output module 498B to the lead 656 to close the close relay contact 620A and the motor 632 closes the proportion gate 24.

The circuitry for the lazy susan 62 is shown at the bottom of FIG. 9G. The bin selection switch 153 and bin rotation switch 154 control the operation of a motor 680. Power is provided through the leads 380 and 336. A signal on the lead 516 from the AC (120 v) output module 457 shown in FIG. 9C activates a start relay 670 which closes contacts 670A, 670B 670C and 670D leading to the motor 680 to effect clockwise rotation of the lazy susan 62. Likewise, a signal on lead 518 activates a start relay 672 and closes its contacts 672A, 672B, 672C and 672D to effect counterclockwise rotation of the lazy susan 62. The lazy susan 62 is rotated to position the sleeve 68 over the proper input port 70 for the color combination of granite granules being transported. Leads 520 and 522 are connected to the AC/DC (120 v) input module 466J as shown in FIG. 9D to send rotation direction inputs to the programmable controller 340. The lazy susan light 76 and the alarm horn are also shown in FIG. 9G.

To start the system the operator turns the system power switch 224 to the "on" position and pushes the system power reset button 230. The pilot light 334 is lit and the system may be operated in the manual or automatic mode.

To effect automatic operation of the system, the operator must first check to see that all the conveyors are empty so that no color combinations are mixed. The operator decides which group of bins 82 or 84 will be used and ensures that that set of bins is empty.

The color code for the color to be run is selected by turning the bin blend selector switch 210 or 212 (depending on which set of granule dispensing bins 82 or 84 is to be used) to the "off" position. The blend select switch 244 is set to reflect the bin group being set. The color code input (thumbwheel) switch 242 are set to the proper color code for the shade of shingle to be made. The button on the blend select switch 244 is pushed and the color code is then displayed in the color indicator 200 or 202.

The operator turns the bin selector switch 216 to the group of bins to be run and turns the bin blend selector switch 210 or 212 to the run position. The headlap bin selector switches 220 for the headlap granule dispensing bins 86 to be used are turned on. The cycle reset push-button 256 is pushed to reset the automatic cycle to the home position and the pilot light for the cycle reset push-button 256 is illuminated. The operator then pushes the auto start button 236.

In the sequence of operation for the automatic system, the priorities for granule dispensing bins 82 or 84 are scanned for the highest priority bin calling for a fill. That bin number is loaded into the active bin register of the programmable controller 340. The lazy susan 62 moves the sleeve 68 over the appropriate input port 70 for the bin to be filled and the linear actuators 112 adjust the proportion gates 24 for the silos to be used until each is set in the proper percentage for the color combination of granite granules to be loaded into that bin. When everything is in position, the system goes on to the next step. If there is any problem, the alarm horn sounds and the automatic operation stops.

The conveyors 28 and 40 start and the first slide gate damper 22 is opened. As the conveyor moves the granite granules past the other needed silos, the slide gate dampers 22 for those silos open. The conveyor 28 transfers the granite granules to the conveyor 40 and the granite granules are weighed and transferred to the trough 54, up the bucket elevator 50, through the chute 60, hopper 64 and sleeve 68 into the input port 70. This step continues until the shut-off level probe 174 for that bin indicates the bin is sufficiently filled. At that time the first slide gate damper 22 is closed and as the conveyor 28 moves along the remaining slide gate dampers 22 close. The conveyors 28 and 40 and bucket elevator 50 continue to run. After conveyors 28 and 40 are empty, the air jets 58 come on to clean out the trough 54 for a short period of time. After a delay to allow the bucket elevator 50 to empty, the conveyors 28 and 40 and bucket elevator 50 stop and the system is reset to fill the next bin. The system may also be programmed to clean the conveyors 28 and 40 and trough 54 and to start a new color combination while granite granules are passing through the lazy susan 62 and then turning the lazy susan 62 before the new color combination arrives. This would reduce the time during which the system is not filling bins and thus increase efficiency.

Once each of the bins required for the run of shingles is filled, the asphalt-coated mat 100 begins moving beneath the dispensers 96A, 96B and 96C and the granite granules are dispensed onto the asphalt-coated mat. Should any of the bins run low on granite granules during the run, the system automatically provides additional granite granules of the proper color combination to that bin. Rather than use the level probes the system can be programmed to use readings from the individual bin scales to dictate when each bin should be filled.

If there is a problem, the conveyor 28 can be stopped using a conveyor stop button that may be included in the system, the safety rope 160 which opens the switch 160A shown in FIG. 9D, the emergency stop push-button 226, or the auto stop button 238. When the conveyor 28 stops, all slide gate dampers close to stop the flow of granules. To restart the system, the auto stop button 238 is pushed and then the auto start button 236 is pushed to continue from the point at which the system was stopped.

While the system is running one shade of shingles, the color combinations for a second shade can be loaded into the second group of bins. To do so, the color code for the color to be run in the second group of bins is loaded. The bin blend selector switch 210 or 212 for the second set of bins is switched to the run position and the bins are automatically filled during the time in which none of the first group of bins or headlap bins is calling for a fill. The bins operating selector switch 216 is set to the group of bins being run and thus those bins have a higher fill priority than the second set of bins.

To make a color change, the bin blend selector switch 210 or 212 for the bins being run is switched to the drain position. The bins automatically cycle through fills that allow them to run down together. When the granite granules in one of the bins fall below the low level probe 170 of that particular bin, the alarm horn sounds and the low level light for that bin begins to flash. The operator sets the bin blend selector switch 210 or 212 for that group of bins to the off position and prepares to change over to a new color as soon as the bin that set off the alarm is emptied. If desired, short duration manual refill buttons may be added to selectively refill any of the dispensing bins 82 or 84 when the bin blend selector switch 210 or 212 is set to the drain position and the granule level is below the fill level probe 172.

The lazy susan 62 is designed to move the sleeve 68 the shortest distance to the input port 70. Therefore, the lazy susan 62 is provided with both the clockwise and counterclockwise control mechanisms and the circuitry to determine which direction of rotation places the sleeve 68 over the input port 70 in the shortest distance. Each time the activator 158 on the sleeve 68 passes the encoder limit switch 156, the lazy susan control circuit receiving the signal from the lazy susan encoder 530 is reset to zero so that slight differences in rotation due to twisting or bending of mechanical parts does not accumulate and result in the sleeve 68 being out of position.

The present system has several advantages. Repeatable formulas result in less error and more consistent colors. There is therefore no need to worry about different shades from different lots because if the meters are periodically calibrated, the shades will be identical or the system will not operate.

The system can be programmed to compare the amount of headlap used per pound of color combination used and alert the operator if the proportion is not acceptable. Maintenance is also facilitated because while one set of bins is being used, workers can fix problems in the other set of bins or work on silos not in use.

The program and apparatus may be adjusted to provide for loading different colors in the same silo at different times by merely adding a switch to the master control panel 180 with a position for each independent color put into that particular silo. The programming can be adjusted to prevent the system from operating unless the proper color is loaded into the silo.

Other modifications may be easily added to the system. For instance, a microswitch may be mounted under the slide gate damper 22 to indicate whether granite granules are falling out of the silo. If not, the system can be programmed to set off an alarm to alert the operators that a silo is empty or clogged. If one of the slide gate dampers 22 or proportion gates 24 is stuck, the air cylinder 118 or linear actuator 112 can be pulsed to alleviate the problem. Finally, even if the system goes down, the entire apparatus may be operated manually. For manual operation, the main control system box 36 is set to manual and the selector switches 124, 126 and 128 are used to operate the silo equipment and selector switches 153 and 154 operate the lazy susan 62.

Should a slide gate damper 22 or a proportion gate 24 or the lazy susan 62 not be set to the proper positions or should a conveyor not be running properly, the control circuitry and master panel 180 alarm and indicate the problem. A worker may then fix the problem.

Should one of the bins run low during a run of shingles, the fill level probe 172 sends a signal to the master control circuitry and that bin is refilled with the granite color combination. The different bins are filled on a priority basis. This priority basis can be programmed so that each bin has a specific priority or may be based on a first-in, first-out priority. The automation system checks the bin, the slide gate dampers 22 and the proportion gates 24 and checks to see if the lazy susan 62 is in the proper position. If any one condition is not met, an alarm sounds and the system stops.

Rather than the encoder 530, proximity switches on the sleeve 68 and input ports 70 may be used. However, in that case the lazy susan 62 is only in contact with the machine while the sleeve 68 is near an input port 70 and the lazy susan 62 does not necessarily rotate the sleeve 68 through the shortest distance to reach the next input port 70.

Although the invention has been described only with regard to manufacture of shingles, it is apparent that the system could be used in plastics and cement manufacture, paint mixing, pharmaceutical and fertilizer manufacture, and many other solid or liquid industrial mixing processes. Although a particular embodiment of the invention has been illustrated in the accompanying drawings and described in the foregoing Detailed Description, it will be understood that the invention is not limited to the embodiment disclosed but is capable of numerous rearrangements, modifications and substitution of parts and elements without departing from the spirit thereof.

I claim:

1. An automated mixing and dispensing apparatus for making shingles comprising:

a plurality of silos each holding a single specific color of granite granules therein and each silo having an output port, a slide gate damper for selectively releasing granite granules through the output port, and a proportion gate to control the amount of granite granules released from the silo;

a conveyor running below the output ports of the silos onto which granite granules released from the silos falls and is mixed with granite granules concurrently released from other silos;

means for controlling each slide gate damper and proportion gate and thereby mixing granite granules on the conveyor in accordance with a selected formula;

means for stopping the apparatus and sounding an alarm if any of the slide gate dampers or proportion gates are not set to the proper position;

a plurality of bins having input ports;

a rotatable lazy susan having a sleeve for dispensing the mixture of granite granules into any one of the bins through its respective input port;

means for transporting the mixture of granite granules from said conveyor to the lazy susan;

means for aligning the sleeve of the lazy susan with the input port for a selected bin to transport a mixture of granite granules to the selected bin;

means for indicating when the bin being filled has sufficient granite granules to make a run of shingles and for stopping the mixing of granite granules for that bin;

means for dispensing the granite granules held in each of the bins onto an asphalt-coated fiberglass mat in a specified pattern;

means for causing the correct formulation of colors of granite granules to fall onto the conveyor, be transported to the lazy susan, and enter the appropriate bin; and programmable means for controlling the apparatus so that after one bin is filled, the slide gate dampers and proportion gates are adjusted and the mixing of granite granules according to a specified formula for another bin is begun, and this process is repeated to fill a plurality of bins with a plurality of mixtures of granite granules, each mixture being held in a separate bin, and then the means for dispensing the granite granules onto the fiberglass mat is activated to make shingles of a specified shade.

2. An automated mixing and dispensign apparatus for making shingles comprising:

a plurality silos each holding a single specific color of granite granules therein and each silo having an output port, a slide gate damper for selectively releasing granite granules through the output port, and a proportion gate to control the amount of granite granules released from the silo;

a conveyor running below the output ports of the silos onto which granite granules released from the silos falls and is mixed with granite granules concurrently released from other silos;

means for controlling each slide gate damper and proportion gate and thereby mixing granite granules on the conveyor in accordance with a selected formula;

a plurality of bins having input ports;

a rotatable lazy susan having a sleeve for dispensing the mixture of granite granules into any one of the bins through its respective input port;

means for transporting the mixture of granite granules from said conveyor to the lazy susan;

means for aligning the sleeve of the lazy susan with the input port for a selected bin to transport a mixture of granite granules to the selected bin;

means for stopping the apparatus and sounding an alarm if the rotatable lazy susan is not in the proper position;

means for indicating when the bin being filled has sufficient granite granules to make a run of shingles and for stopping the mixing of granite granules for that bin;

means for dispensing the granite granules held in each of the bins onto an asphalt-coated fiberglass mat in a specified pattern;

means for causing the correct formulation of colors of granite granules to fall onto the conveyor, be transported to the lazy susan, and enter the appropriate bin; and programmable means for controlling the apparatus so that after one bin is filled, the slide gate dampers and proportion gates are adjusted and the mixing of granite granules according to a specified formula for another bin is begun, and this process is repeated to fill a plurality of bins with a plurality of mixtures of granite granules, each mixture being held in a separate bin, and then the means for dispensing the granite granules onto the fiberglass mat is activated to make shingles of a specified shade.

* * * * *